United States Patent [19]

Marcato

[11] Patent Number: 4,576,122

[45] Date of Patent: Mar. 18, 1986

[54] ROAD-MARKING MATERIAL HEATING SYSTEM

[76] Inventor: Forrest C. Marcato, 823 James Ct., Pike Road, Ala. 36064

[21] Appl. No.: 591,415

[22] Filed: Mar. 20, 1984

[51] Int. Cl.[4] ..... F22B 9/02

[52] U.S. Cl. ..... 122/26; 237/12.3 R; 126/247

[58] Field of Search ..... 237/1 R, 12.3 B, 12.3 R; 122/26; 126/247, 19.5; 239/129, 135

[56] References Cited

U.S. PATENT DOCUMENTS 3,092,325 6/1963 Brown, Jr. et al. .
3,813,036 5/1974 Lutz .
3,820,718 6/1974 Ammon .
4,060,194 11/1977 Lutz .
4,190,205 2/1980 Mitchell .
4,293,092 10/1981 Hatz et al. ..... 237/1 R
4,372,254 2/1983 Hildebrandt .
4,381,762 5/1983 Ernst .
4,387,851 6/1983 Dick .

*Primary Examiner*—Henry Bennett
*Attorney, Agent, or Firm*—Banner, Birch, McKie & Beckett

[57] ABSTRACT

A mechanical heat-generating system for heating a road-marking material being sprayed onto a road surface from a vehicle is disclosed. The system includes a heat exchanger for placing the road-marking material in indirect contact with a heat exchange fluid at an elevated temperature to raise the temperature of the road-marking material. The heat exchange fluid is stored in a tank which functions as a controlled heat source. A heat generator mechanically heats the heat exchange fluid during the passage of the fluid through the generator. A pump mechanism pumps the fluid through conduits connecting the heat exchanger, storage tank and heat generator.

26 Claims, 5 Drawing Figures

FIG. 3.
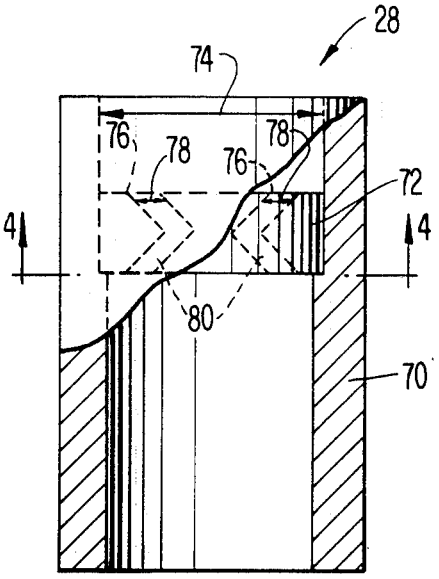
FIG. 4.
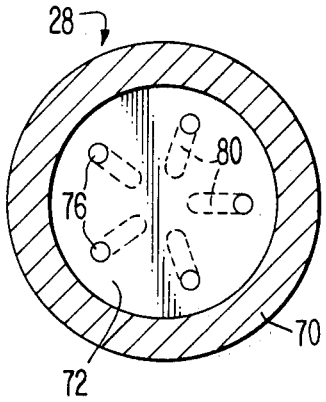
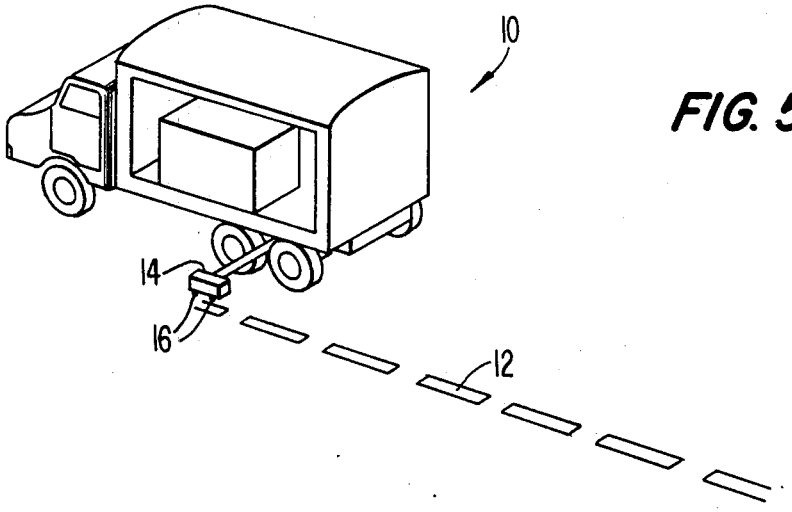
FIG. 5.

ROAD-MARKING MATERIAL HEATING SYSTEM

TECHNICAL FIELD

The present invention relates to road-marking equipment. More particularly, the present invention relates to a system for heating road-marking material immediately prior to the application of the material to a road surface.

BACKGROUND OF THE INVENTION

Road-marking equipment generally includes a self-propelled vehicle which is driven by an operator over a surface while a stripe or line of marking material is applied to the surface. The vehicle carries the road-marking material and all of the equipment necessary to apply the material in a stripe to the road surface; for example, applicators, air compressors, supplemental engines, supplemental fuel supplies, and heat generator systems. Road-marking materials, including thermoplastic materials alkyd-based paint, chlorinated rubber-based paint, acrylic-based paint and paint containing water-soluble polymers require heating prior to their application to a road surface. Several types of heating systems have been used in the past, all with certain drawbacks.

One type of heating system utilizes a fired boiler which heats a heat exhange medium, such as an anti-freeze or oil mixture, which after heating by the boiler is transported to an indirect heat exchanger to transfer its heat to the road-marking material. This type of system suffers both maintenance and safety drawbacks. A flame source, fueled by a volitile substance such as propane gas, diesel fuel, fuel oil or kerosene, heats the boiler and presents a potential fire hazard, particularly since the vehicle carries other combustible substances such as flamable marking material, gasoline, or diesel fuel. This danger is further complicated by the thermostatically controlled electrical ignition system, typically used to control the start-up of the boiler. For example, if the burner fails to ignite properly, the boiler can become flooded with fuel so that when ignition does occur an explosion can occur. Total destruction of striping trucks have been reported due to boiler-related fires.

Another road-marking material heating system, developed primarily to alleviate the safety problems of boiler systems, is an indirect heating system wherein heat generated by the various motors on the vehicle is utilized to indirectly heat the road-marking material. These systems derive their heat from one or more sources, such as the engine-coolant, exhaust gasses, or hot compressed air. Examples of such systems are found in U.S. Pat. Nos. 3,092,325 and 4,190,205. While alleviating some of the safety problems of boiler systems, such systems generally do not produce enough heat to adequately heat road-marking material so that it can be applied at today's higher striping speeds.

A third type of heating system utilizes direct mechanical or friction heating of the marking material itself. Such a system is illustrated in U.S. Pat. No. 3,830,718. This system, however, also suffers numerous drawbacks such as high manufacturing cost, tendency to break down the chemical elements of the road-marking material, and incompatibility with WATERBORNE or acrylic-based paint.

SUMMARY OF THE INVENTION

The present invention is directed to a mechanical heat-generating system for heating a road-marking material being sprayed onto a road surface from a vehicle. The system includes a heat exchanger mechanism for placing a road-marking material in indirect contact with a heat exchange fluid at an elevated temperature to raise the temperature of the road-marking material. A heat exchange fluid storage tank stores a reservoir of the heat-exchange fluid. A heat generator mechanically heats the heat exchange fluid during its passage through the generator. Conduits connect the heat exchanger mechanism, the storage tank and the heat generator. A pump is provided for circulating the heat exchange fluid through the heat exchanger, the storage tank and the heat generator.

At least one road-marking material storage tank holds road-marking material and tubing connects the road-marking material storage tank with at least one applicator for applying the marking material to a road surface. The tubing passes the road-marking material through the heat exchanger prior to its passage to the applicator.

The hydraulic heat generator is located upstream of the heat exchange fluid storage tank so that the heat exchange fluid which has been heated by the heat generator passes to the storage tank, which functions as a control tank for storing a relatively large reservoir of heat exchange fluid at a controlled, elevated temperature. A control means, including a thermostat which senses the temperature of the fluid in the tank and a solenoid actuated, flow control valve which is turned on and off by the thermostat, controls the flow of the heat exchange fluid through the heat generator. The thermostat senses when the temperature of the heat exchange fluid in the control tank is insufficient to heat the marking material and activates the control valve to direct a flow of the heat exchange fluid through the heat generator. This flow of heat exchange fluid continues until the temperature of the heat exchange fluid in the control tank is sufficient.

A separate circulator pump is provided for drawing the heated heat exchange fluid from the control tank through the heat exchangers.

The heat-generating system of the present invention has numerous advantages over the heating systems of the prior art. For example, the present system overcomes the safety problems of boiler systems because its flameless operation eliminates the risk of fires or explosions. Its simple hydraulic operation results in low or no maintenance and in a lightweight system. Furthermore, after a several-minute warm-up period wherein the heat exchange fluid is passed through the heat generator, heat is supplied almost instantaneously, and at an adequate level for today's high-speed road-marking applications.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

BRIEF DESCRIPTION OF THE DRAWINGS

FIG. 3 is a side view, partially in section, of a heat generator in accordance with the present invention;

FIG. 4 is a sectional view taken generally along line 4—4 of FIG. 3; and

FIG. 5 is a diagrammatic perspective of a road-marking vehicle.

DETAILED DESCRIPTION OF THE INVENTION

Figure 1:
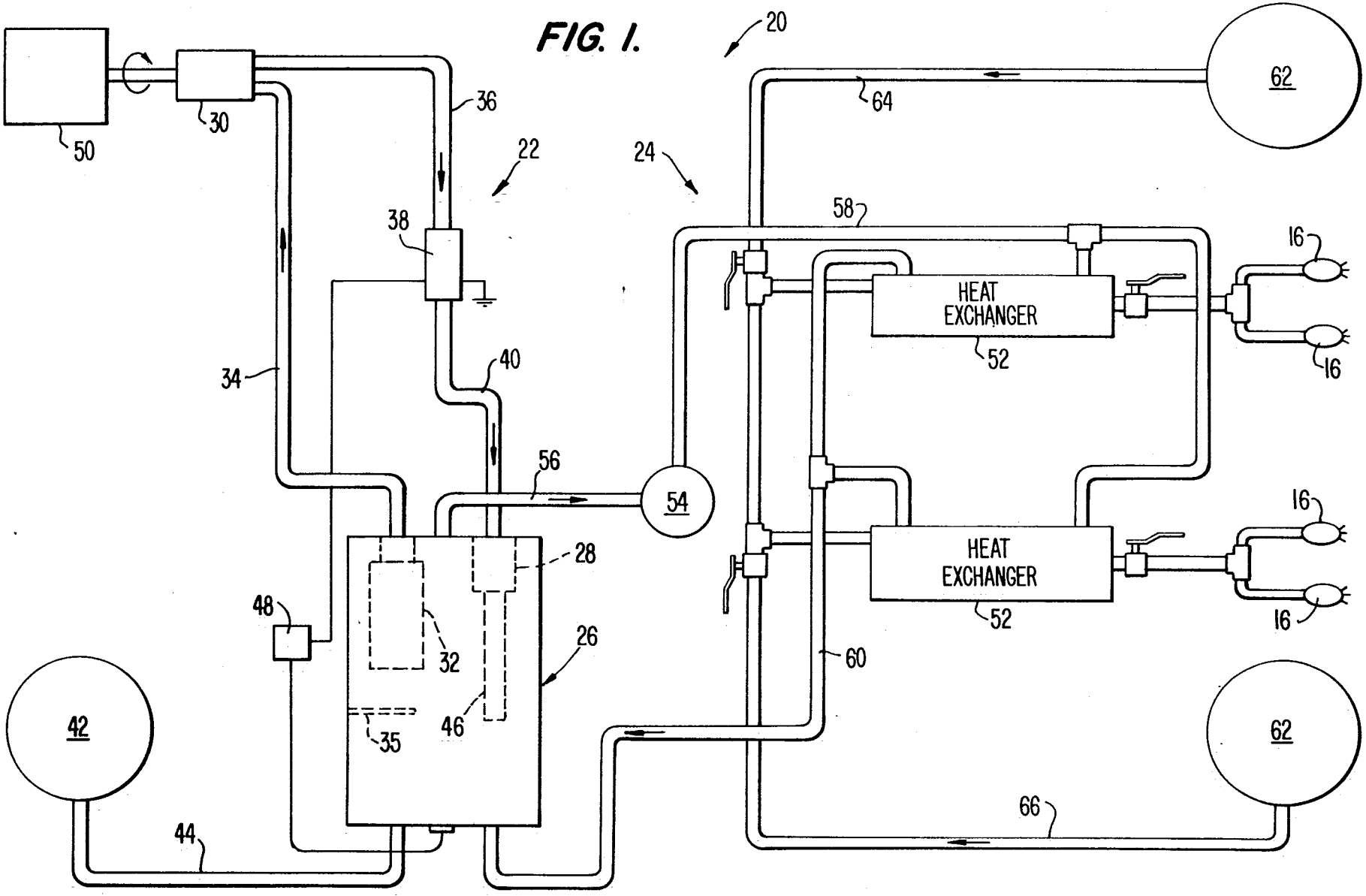
FIG. 1 is a schematic view of one embodiment of a heat-generating system in accordance with the present invention.

Referring to the drawings in detail, wherein like numerals indicate like elements, there is shown in FIG. 5 a road-marking vehicle, designated generally as 10. Vehicle 10 is illustrated as having applied a plurality of stripes 12 to a road surface. Vehicle 10 can be any conventional road-marking vehicle, which is capable of carrying the heat-generating system of the present invention. Details of the vehicle, which are known to those skilled in the art, will not be described in detail. Vehicle 10 includes an applicator arm 14, from which a plurality of road-marking applicators 16 extend. Road-marking material is supplied to applicators 16 from a source, after being heated through a heat-generating system.

FIG. 1 illustrates a first embodiment of a heat-generating system in accordance with the present invention designated as 20. System 20 includes a heat-generating section 22 and a heat exchange section 24. In heat-generating section 22 a reservoir of heat exchange fluid is stored in a tank 26. The temperature of the heat exchange fluid is elevated by circulating it through a mechanical heat generator 28. A variable displacement hydraulic pump 30 pumps the fluid from tank 26 through a filter 32 and an outlet conduit 34. A baffle 35 reduces turbulence in tank 26. The heat exchange fluid passes from pump 30 through a conduit 36, a flow-control valve 38, and an inlet conduit 40 to the heat generator 23. Tank 26 is not vented to atmosphere, but an expansion tank 42 is connected to tank 26 via a conduit 44. An extension tube 46 is connected to the outlet end of heat generator 28 and extends to approximately the middle of tank 26 to reduce turbulence in tank 26 caused by the fluid exiting heat generator 28.

Tank 26 functions both as a storage tank for the heat exchange fluid and as a controlled heat tank for providing a temperature-controlled source of heat exchange fluid. The temperature of the heat exchange fluid in tank 26 is controlled by the intercooperation of a thermostat 48, flow-control valve 38 and hydraulic pump 30. Thermostat 48 is set at a preselected temperature sufficient to raise the temperature of the road-marking material passing through the heat exchangers to a desired temperature for application to a road surface. If the temperature of the heat exchange fluid in tank 26 is below this preselected temperature, a solenoid which controls flow-control valve 38 is activated and opens the valve. With the valve open, hydraulic pump 30 is free to be driven by a power source 50. Power source 50 can be a separate engine carried by vehicle 10 or the internal combustion engine which drives vehicle 10. The heat exchange fluid thus passes through heat generator 28 and its temperature is elevated. This circulation continues until the preselected temperature for the heat exchange fluid is reached. Thermostat 48 then signals flow-control valve 38 to shut off. This causes back pressure in conduit 36, which shuts off the variable-displacement hydraulic pump 30. At initial start-up, this circulation may be needed for a few minutes to elevate the temperature of the fluid in tank 26 to the preselected temperature; however, once this temperature is reached and a road-striping operation is proceeding, only intermittent operation of the hydraulic pump for several seconds (for example, 10–60 seconds) is required to keep the heat exchange fluid at its preselected temperature. The temperature for the heat exchange fluid depends upon the particular type of road-striping material which is being applied and the speed at which it is to be applied. Typically, for non-thermoplastic road-striping materials the temperature could be in the range of 110°–220° F.

When the heat exchange fluid has reached the preselected temperature, it is circulated through heat exchangers 52 by a circulator pump 54, via conduits 56, 58 and 60. Heat exchangers 52 are illustrated as supplying heat to two different sources of road-marking material from tanks 62. Tanks 62 could, for example, hold road-marking materials of different color. The road-marking material is delivered to heat exchangers 52 through tubing 64, 66. Heat exchangers 52 are of conventional design and indirectly heat the road-marking material passing through them by indirect contact with the heat exchange fluid also passing through heat exchangers. After being heated in heat exchangers 52, the road-marking material is applied to the road surface by applicators 16. The road-marking material is moved from tanks 62 to applicators 16 by a conventional pump or pressure tank mechanism.

FIGS. 3 and 4 illustrate in greater detail the operation of heat generator 28. As seen therein, generator 28 includes a cylindrical body 70 and a plug 72. Cylindrical body 70 has an inner diameter 74, preferably approximately equal to the inner diameter of an inlet conduit 40. Plug 72 is provided with a plurality of inlet orifices 76 which have an inner diameter 78 substantially less than the inlet diameter 74.

The plurality of orifices 76 are arranged in a circular pattern about plug 72. Each orifice 76 communicates with a channel 80 having a similarly narrow inner diameter 78. Each channel 80 includes a bend of 90° at the center of its length. The fluid exits channels 80 into a lower portion of cylindrical body 70 having an inner diameter similar to that of the upper-inlet portion of body 70. The heat exchange fluid is mechanically heated during its passage through heat generator 28 for a number of reasons including compression of the fluid through the restricted diameter orifices and channels, friction due to the changes in direction of the fluid during passage through the heat generator (a 45° change of direction passing from the inlet end of tube 40 and into the orifices 76, a 90° change within channels 80, and a 45° change on exiting channels 80), and the pressure drop over a restricted orifice.

Figure 2:
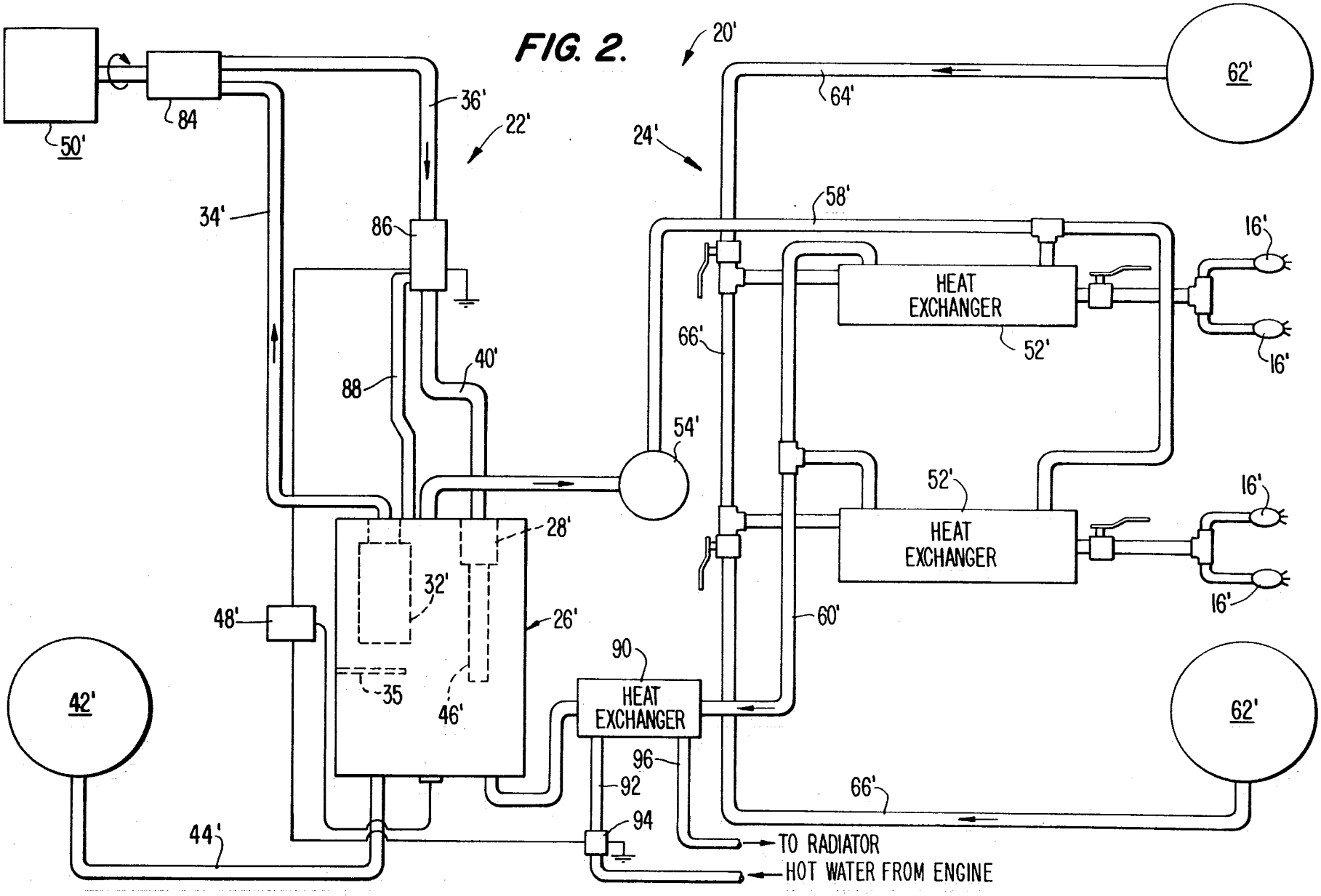
FIG. 2 is a schematic of a second embodiment of a heat-generating system in accordance with the present invention.

A second embodiment of a heat-generating system is illustrated in FIG. 2 and is designated as 20'. Portions of system 20' which are similar to portions of system 20 will be indicated by like primed numerals. System 20' is the same as system 20 except in two areas, i.e., the type of hydraulic pump and flow control valve used, and the addition of a supplemental heat exchanger.

System 20' uses a fixed volume hydraulic pump 84 to pump the heat exchange fluid from tank 26'. A directional flow control valve 86 controls whether or not the heat exchange fluid is pumped through heat generator 28', or is bypassed and circulated to the tank 28' via a bypass conduit 88. Pump 84 is driven continually by power source 50'. When thermostat 48' senses that the temperature of the fluid in tank 26' is insufficient, a soilenoid is actuated to move directional control valve to a position wherein the fluid is passed through inlet conduit 40' and heat generator 28'. When the temperature of the fluid is at the preselected temperature in tank 26', thermostat 48' moves control valve 86 to a position wherein the fluid bypasses heat generator 28' by passage through bypass conduit 88.

If additional heat is required to maintain the heat exchange fluid at the desired temperature in tank 26', a supplemental heat exchanger 90 can be incorporated into the system. Heat exchanger 90 is of conventional design and utilizes the hot liquid from the internal combustion engine or a supplemental engine coolant system on the vehicle for providing heat. The hot liquid from the engine is supplied to heat exchanger 90 through an inlet conduit 92, which is controlled by a soilenoid-actuated on-off valve 94, which in turn is activated by thermostat 48'. The heat exchange fluid returning to tanks 26' from heat exchangers 52' is heated during passage through supplemental heat exchanger 95 by indirect contact with the engine coolant-liquid also passing through heat exchanger 90. After passage through heat exchanger 90, the engine coolant-liquid is returned to the engine radiator via a return conduit 96.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. A mechanical heat-generating system for indirectly heating a road-marking material being applied onto a road surface from a vehicle comprising:

heat exchanger means for placing a road-marking material in indirect contact with a heat exchange fluid at an elevated temperature to raise the temperature of the road-marking material;

heat exchange fluid storage tank means for storing a reservoir of the heat exchange fluid at a preselected elevated temperature during road-marking material application;

heat-generator means for mechanically heating the heat exchange fluid during the passage of the fluid through the generator to raise the temperature of the heat exchange fluid to be passed to said heat exchange fluid storage tank means;

conduit means for connecting in fluid communication said heat exchanger means, said storage tank means and said heat-generator means; and pump means for pumping the heat exchange fluid through said heat exchanger means, said storage tank means and said heat-generator means so that the temperature of the heat exchange fluid is raised during its passage through said heat-generator means, the heat exchange fluid is passed from said heat-generator means to said storage tank means to be stored therein at the preselected elevated temperature and is passed from said storage tank means to said heat exchanger means.

2. A system in accordance with claim 1 including at least one road-marking material holding tank, marking material applicator means for applying the marking material to a road surface and tubing for carrying the marking material from said holding tank, through said heat exchanger means and thereafter through said applicator means.

3. A system in accordance with claim 1 including control means for controlling the temperature at which the heat exchange fluid is held in said storage tank means.

4. A system in accordance with claim 3 wherein said control means includes a flow control valve for controlling the flow of the heat exchange fluid through the heat-generator means and a thermostat for sensing the temperature of the heat exchange fluid in said storage tank means and controlling the operation of said flow control valve in response to the sensed temperature.

5. A system in accordance with claim 4 wherein said pump means includes a variable-volume hydraulic pump for circulating the heat exchange fluid through said flow control valve, said heat-generator means and said storage tank means.

6. A system in accordance with claim 5 wherein said flow-control valve is an on-/off-type valve.

7. A system in accordance with claim 4 wherein pump means includes a fixed-volume hydraulic pump, said flow-control valve is a directional valve, and said conduit means includes a by-pass conduit connecting said flow-control valve directly with said storage tank means, thereby by-passing said heat-generator means, said directional valve directing the flow of the heat exchange fluid from said pump either to said by-pass conduit or said heat-generator means.

8. A system in accordance with claim 1 or 2 wherein said heat-generator means includes a plurality of orifices each having an area substantially less than the area of the conduit means immediately upstream of said generator means.

9. A system in accordance with claim 8 wherein said orifices each communicate with a channel having a cross-sectional area substantially less than the area of the conduit means immediately upstream of said orifice.

10. A system in accordance with claim 9 wherein said channels change direction.

11. A system in accordance with claim 8 wherein said heat-generator means is located, at least partially, in said storage tank means.

12. A system in accordance with claim 1 or 2 wherein said pump means includes a hydraulic pump for circulating the heat exchange fluid through a first portion of said conduit means, said heat-generator means and said storage tank means, and a circulator pump for circulating the heat exchange fluid through a second portion of said conduit means, said heat exchanger means and said storage tank means.

13. A system in accordance with claim 1 or 2 wherein a supplemental heat exchanger is coupled in indirect contact to said conduit means for additionally heating the heat exchange fluid.

14. A system in accordance with claim 13 wherein said supplemental heat exchanger is adapted to be connected to a hot-liquid source of an engine cooling system.

15. A system in accordance with claim 1 or 2 including an expansion tank connected to said storage tank means.

16. A system in accordance with claim 2 including a self-propelled vehicle for carrying said heat exchanger means, said storage tank means, said heat generator means, said conduit means, said pump means, said road-marking material holding tanks, said tubing and said applicator means.

17. Apparatus for applying road-marking material to a road surface comprising:

a vehicle;

a road-marking material heating and applying system carried on said vehicle, said system including:

heat exchanger means for placing a road-marking material in indirect contact with a heat exchange fluid at an elevated temperature to raise the temperature of the road-marking material;

heat exchange fluid storage tank means for storing a reservoir of the heat exchange fluid at a preselected elevated temperature during road-marking material application;

heat-generating means for mechanically heating the heat exchange fluid during the passage of the fluid through the generator means, said generator means being located so that the fluid heated by passage through said generator means passes to said storage tank means to raise the temperature of the heat exchange fluid in said storage tank means;

conduit means for connecting in fluid communication said heat exchanger means, said storage tank means and said heat-generator means;

said heat-generator means includes at least one orifice having an area substantially less than the area of the conduit means immediately upstream of said generator means;

pump means for pumping the heat exchange fluid through said heat exchanger means, said storage tank means and said heat-generator means so that the temperature of the heat exchange fluid is raised during its passage through said heat-generator means, the heat exchange fluid is passed from said heat-generator means to said storage tank means to be stored therein at the preselected elevated temperature and is passed from said storage tank means to said heat exchanger means;

at least one road-marking material holding tank;

marking material applicator means for applying the marking material to a road surface;

tubing for carrying the marking material from said holding tank, through said heat exchanger means and thereafter to said applicator means; and control means for controlling the temperature at which the heat exchange fluid is held in said storage tank means.

18. An apparatus in accordance with claim 17 wherein said at least one orifice includes a plurality orifices.

19. An apparatus in accordance with claim 18 wherein said orifices each communicate with a channel having a cross-sectional area substantially less than the area of the conduit means immediately upstream of said orifice, and said channels change direction.

20. An apparatus in accordance with claim 17, 18 or 19 wherein said hydraulic heat-generator means is located, at least partially, in said storage tank means.

21. An apparatus in accordance with claim 17, 18 or 19 wherein said control means includes a flow control valve for controlling the flow of the heat exchange fluid through the heat-generator means and a thermostat for sensing the temperature of the heat exchange fluid in said storage tank means and controlling the operation of said flow control valve in response to the sensed temperature.

22. An apparatus in accordance with claim 21 wherein said flow-control valve is an on-off type valve, and said pump means includes a variable-volume hydraulic pump for circulating the heat exchange fluid through said flow control valve, said heat-generator means and said storage tank means.

23. An apparatus in accordance with claim 21 wherein pump means includes a fixed-volume hydraulic pump, said flow-control valve is a directional valve, and said conduit means includes a by-pass conduit connecting said flow-control valve directly with said storage tank means, thereby by-passing said heat-generator means, said directional valve directing the flow of the heat exchange fluid from said pump either to said by-pass conduit or said heat-generator means.

24. An apparatus in accordance with claim 17, 18 or 19 wherein said pump means includes a hydraulic pump for circulating the heat exchange fluid through a first portion of said conduit means, said heat-generator means and said storage tank means, and a circulator pump for circulating the heat exchange fluid through a second portion of said conduit means, said heat exchanger means and said storage tank means.

25. An apparatus in accordance with claim 17, 18 or 19 wherein a supplemental heat exchanger is coupled in indirect contact to said conduit means for additionally heating the heat exchange fluid, and is adapted to be connected to a hot-liquid source of an engine cooling system.

26. An apparatus in accordance with claim 17, 18 or 19 including an expansion tank connected to said storage tank means.

* * * * *